United States Patent [19]

Watts

[11] 4,340,771

[45] Jul. 20, 1982

[54] COMMUNICATIONS CABLE HAVING COMBINATION SHIELDING-ARMOR MEMBER

[75] Inventor: William M. Watts, Hickory, N.C.

[73] Assignee: Siecor Corporation, Hickory, N.C.

[21] Appl. No.: 244,238

[22] Filed: Mar. 16, 1981

[51] Int. Cl.[3] ..... H01B 11/06

[52] U.S. Cl. ..... 174/36; 174/106 D; 174/107

[58] Field of Search ..... 174/36, 102 D, 106 R, 174/106 D, 107, 105 B

[56] References Cited

U.S. PATENT DOCUMENTS

| | | | |
|---|---|---|---|
| 1,979,402 | 11/1934 | Nyquist | 174/36 X |
| 3,405,228 | 8/1968 | Polizzano | 174/106 D |
| 3,555,169 | 1/1971 | Miller | 174/36 |
| 3,602,633 | 8/1971 | Miller et al. | 174/36 |
| 3,622,683 | 11/1971 | Roberts | 174/36 |
| 4,010,315 | 3/1977 | Mildner | 174/107 |
| 4,085,284 | 4/1978 | Olszewski et al. | 174/36 |
| 4,145,567 | 3/1979 | Bahder et al. | 174/107 |
| 4,165,442 | 8/1979 | Gabriel et al. | 174/36 |
| 4,256,921 | 3/1981 | Bahder | 174/107 |

FOREIGN PATENT DOCUMENTS

| | | |
|---|---|---|
| 105876 | 12/1938 | Australia . |
| 852028 | 10/1939 | France . |
| 55-31688 | 7/1980 | Japan . |

OTHER PUBLICATIONS

Advertisement "Super T-Screen", *Superior/Cable.*

*Primary Examiner*—Volodymyr Y. Mayewsky
*Attorney, Agent, or Firm*—Roy B. Moffitt

[57] ABSTRACT

An improved internally screened cable is disclosed that not only provides efficient shielding to meet near-end cross-talk requirements in present day and anticipated future carrier systems, but also armor protection as well, both the shielding and armor protection arising out of a single metallic shielding tape composed of two layers of aluminum or copper metallurgically bonded to both surfaces of an iron or steel layer. The tape is corrugated and has a medial portion integrally joined to two terminal portions. The cable core is composed of two groups of conductors divided and shielded one from the other by the medial portion of the shielding tape. Terminal portions of the shield are bent in opposite directions and lie on the periphery of the groups of the core and extend to and beyond that point where the medial and terminal portions merge.

6 Claims, 8 Drawing Figures

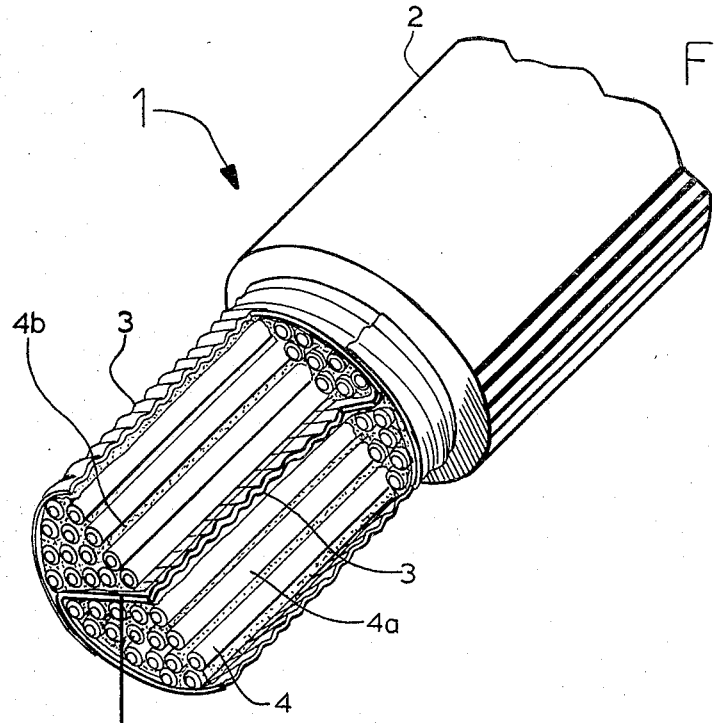
FIGURE 1
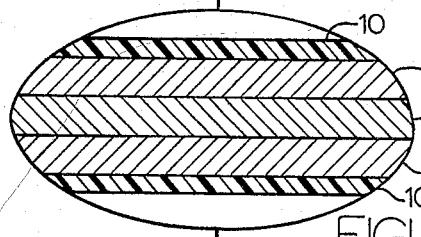
FIGURE 1a
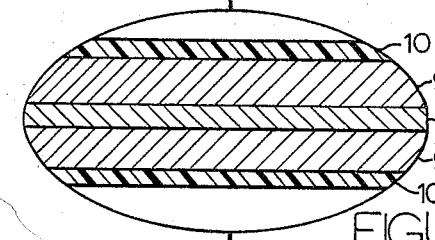
FIGURE 1b
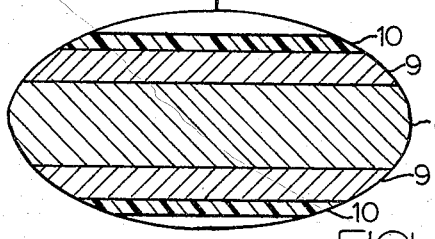
FIGURE 1c
FIGURE 2a
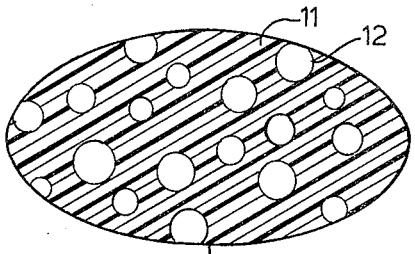
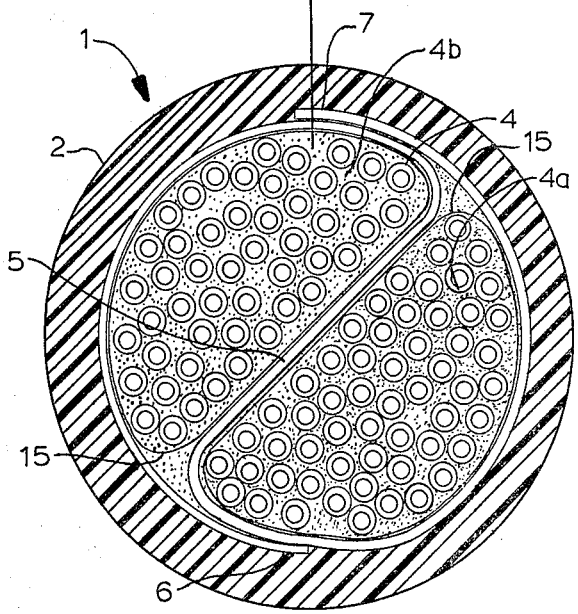
FIGURE 2

COMMUNICATIONS CABLE HAVING COMBINATION SHIELDING-ARMOR MEMBER

BACKGROUND AND SUMMARY OF THE INVENTION

Beginning in 1934, with the issuance of U.S. Pat. No. 1,979,402, entitled "Concentric Shield for Cables" (Nyquist Patent), the communications industry has shown renewed interest in increasing channel capacity in what is now referred to as Pulse Code Modulation carrier systems (PCM systems). The Nyquist Patent directed itself to the problem of transmitting signals of the same frequency in two directions within the same cable in the so-called carrier frequency range. It disclosed: that it was desirable that the conductors used for transmitting signals in one direction be electrically shielded from those transmitting signals in the opposite direction; that shielding material could be a thin tape of soft iron, alternating with layers of copper; a theoretical rationale and mathematic equations to support the conclusion that the product of the permeability and the conductivity of the iron is large, therefore, making its attenuating effect also large, thus having a shielding effect of a desirable magnitude; and that the ratio of the permeability of the iron to its conductivity is quite different from that of copper or other conductive materials and that the combination of iron and copper in alternating layers (no metallurgical bonding disclosed) caused electromatic wave reflection loss brought about by interfering waves. For the sake of completeness, the disclosure of Nyquist's teaching (U.S. Pat. No. 1,979,402) is incorporated by reference.

In 1937, an Australian Pat. No. (105,876) issued which essentially duplicated the teachings of Nyquist and went on further to disclose a telephone cable having a core that was divided into two groups, each group being essentially completely surrounded by alternating layers of iron and aluminum. The two groups of conductors were "D shaped" in cross section and fitted together so that the composite core had a cross section that was essentially circular.

A great deal of time thereafter transpired before any significant additional attention was given to the problem of near-end cross-talk, such as that addressed by Nyquist and the Australian Patent.

In 1971, there appeared a patent to Roberts et al. (U.S. Pat. No. 3,622,683), which might be identified as the beginning of the modern day interest relative to internally screened cable for for use in PCM communications systems. This patent and those that followed, an example of which is U.S. Pat. No. 4,085,284, all addressed themselves to the problem of near-end cross-talk associated with internally screened cables in PCM systems. These disclosures, beginning with Nyquist up to the present time, never addressed the problem of armoring the screen of an internally screened cable not only to provide the screening function between conductor but also to protect the conductors from mechanical forces that would otherwise destroy the integrity of the cable and cracking of the internal screen as a result of bending or flexing of the cable along anyone of its axes. The Roberts et al. teaching does disclose a conventional armoring means to protecting a cable from outside forces (armoring) in the form of a metal tape folded around the outer periphery of a cable core. This metal tape was also denoted as a metal shield and such shielding was in addition to still another shield, an internal radially extended shield that longitudinally divided the cable core into two groups.

Corrugation of a single metal internal screen in an internally screened cable is disclosed by French Pat. No. 852,028.

The instant invention addresses itself to the problems associated with internally screened cable, problems of cracking of internal screens when flexed either during installation or service and the integrating of a protective armor layer within the screen itself. Both the shielding and armor protection characteristics of the invention arise out of a single metallic tape shield composed of two layers of aluminum or copper bonded to both surfaces of a middle iron or steel layer. The tape has a medial portion integrally joined to two terminal portions. The cable core is made up of two groups of conductors divided one from the other by the medial portion of the shielding tape. The terminal portions are bent in opposite directions and lie on the periphery of opposing groups and extend to and beyond that point where the medial and terminal portions merge, thus disposing the terminal free edges of the single bimetallic screen on circumferentially spaced apart portions of the cable core. One feature of the invention calls for the shield to be corrugated throughout. It is believed that the corrugations contribute to and/or are the basis for more than one of the desirable features of the invention described in the more detailed portion of this disclosure.

Other objects, features and advantages of the invention will appear or be pointed out as the description proceeds.

BRIEF DESCRIPTION OF THE DRAWINGS

In the drawings, forming a part thereof, in which like reference characters indicate corresponding part in all the views:

FIG. 1 is an isometric view of the cable of the instant invention;

FIGS. 1*a*, 1*b* and 1*c* are exploded views of the cross section of the internal screen of FIG. 1;

FIG. 2 is a diagrammatic cross section of the cable of FIG. 1 having one exploded view, FIG. 2*a*, showing a cable filling compound occupying the space delimited by the shield not otherwise occupied by conductors, such filling compound being a grease or rubber-like material containing inorganic microspheres;

DESCRIPTION OF THE PREFERRED EMBODIMENT

Figure 3A:
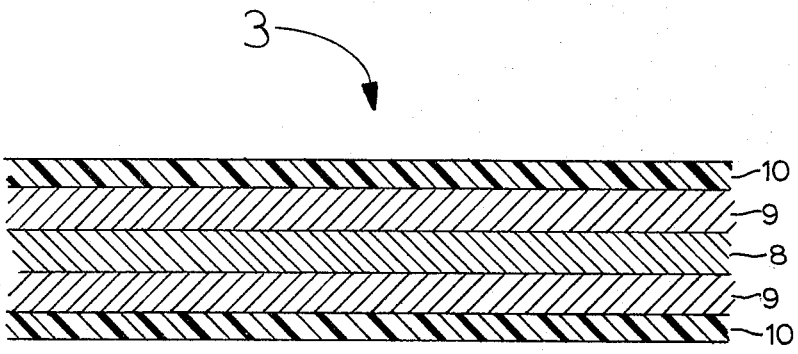
FIG. 3*a* is a cross section of an example of the shielding tape of FIG. 1*a* in the uncorrugated state; and, FIG. 3*b* is a cross sectional view of the metal shielding tape of FIG. 3*a* after corrugation, to illustrate the increased effective thickness resulting from corrugation.

Referring to FIG. 1, element 1 refers to the overall cable of the instant invention, which has as its major components a single metal shielding tape 3, conductors 4, and jacket 2. Jacket 2 is extruded polyethylene of either high or low density or mixtures thereof along with suitable fillers such as carbon and the like, all of which are well-known in the prior art. Single metal shielding tape 3 is a bimetallic tape coated on both of its major surfaces with a modified polymer of polyethylene 10 such as that as described in U.S. Pat. No. 2,970,129 to Rugg et al., the contents of which is incorporated herein by reference. A similar or like modified polyethylene described in U.S. Pat. No. 3,233,036 to Jachimowicz is also applicable.

The metal portion of the tape is composed of three layers such as that shown in FIGS. 1*a*, 1*b* and 1*c* in exploded views. Layer 8 is the middle layer and is composed of iron, steel or alloys thereof. On both sides of the iron layer, there is metallurgically bonded thereto a layer 9 of aluminum or copper or alloys thereof. To the outermost layers of aluminum or copper layer 9 is bonded plastic layer 10.

The thickness of layers 9 relative to layer 8 is of some significance. Whereas layer 8 may be equal to, greater or smaller than the thickness of layers 9, layers 9 are co-equal in thickness. Embodiments of the possible variations in thickness are shown in the exploded views of FIGS. 1*a*, 1*b* and 1*c*.

Shown in FIG. 2*a* is an exploded view of the space delimited by single metal shielding tape 3 not otherwise occupied by conductors 4 in cable 1. Such space can be filled with conventional filling compounds such as polyethylene grease, petrolatum or block copolymer rubbers 11, some of the aforementioned either per se, with or without inorganic microspheres 12 and other additives such as stearate and polyethylene.

Figure 3B:
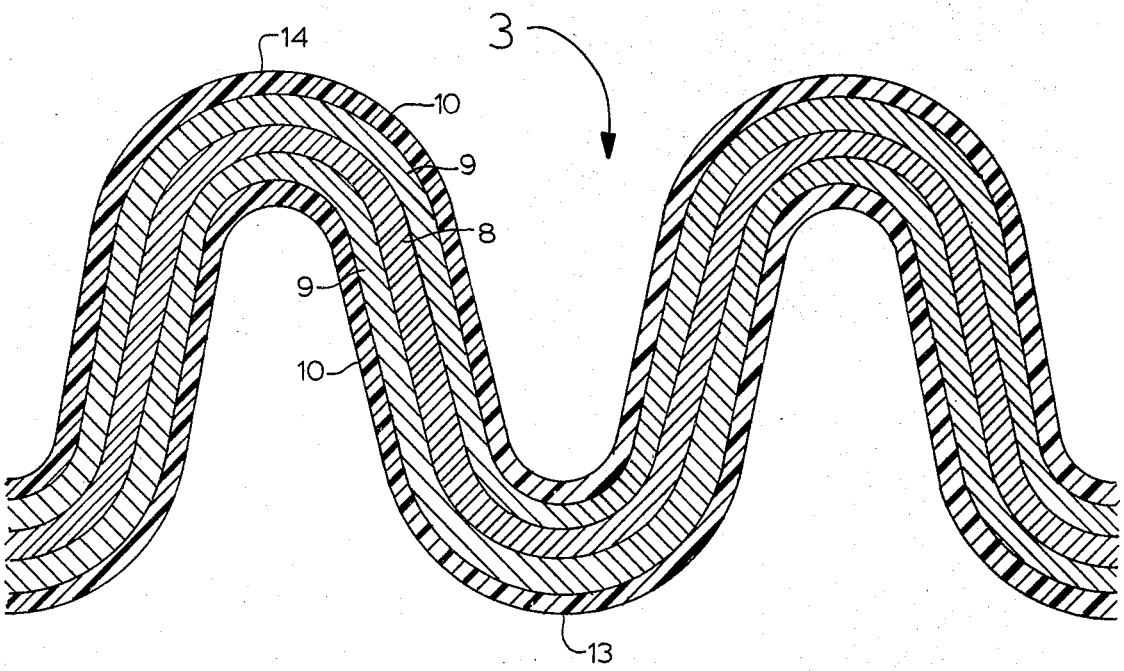

Corrugations of the single metal shielding tape 3, see elements 13 and 14 of FIG. 3*b*, extend throughout the shielding tape and include not only that portion shown circumferentially surrounding conductors 4 but also that portion that divides conductors 4 into two groups 4*a* and 4*b*.

Single metal shielding tape 3 extends longitudinally throughout the cable and is conveniently divided, for the purpose of description, into two basic areas, the medial or radial portion 5 and terminal portions 6 and 7. Radial portion 5 is integrally joined to and between terminal portions 6 and 7. It will be noted that medial or radial portion 5 merges with terminal portions 6 and 7 at two circumferentially spaced apart locations. The basic function of the medial or radial portion 5 is to divide and separate as well as to screen conductors of group 4*a* from the conductors of group 4*b*. It is well recognized in the prior art, within the context of internally screened cable, to divide conductors of a cable into two groups, like that of 4*a* and 4*b*, for the purpose of transmitting signals in one direction with one group and in opposite direction with the other group. Terminal portion 7, which is integrally and continuously joined to medial or radial portion 5, is bent to the left and extends around the periphery of group 4*b* to and beyond that juncture where the medial or radial portion 5 joins or merges with a like member, terminal portion 6. Terminal portion 6 is bent in a direction opposite from that of terminal portion 7 and extends around and lies adjacent to the outer periphery of group 4*a* and like that of terminal portion 7, extends to and beyond that juncture where medial or radial portion 5 merges with terminal portion 7. It will be noted that the free edge of terminal portion 7 extends a short distance beyond that plane in which the medial or radial portion 5 lies and the same is true of the free edge of terminal portion 6 (overlaps). Both so-called overlaps are circumferentially spaced apart from one another and lie on the outer periphery of the cable core, which is a composite made from groups 4*a* and 4*b*. That portion of tape 3 apart from radial portion 5 and the portion covered by the overlaps may be bonded to jacket 2.

If desired, a core wrap 15, such as a corrugated or noncorrugated plastic tape, can be disposed between screen 3 and conductors 4 to individually wrap and circumscribe groups 4*a* and 4*b*. These are individual tapes, not connected one to the other.

The screen configuration just described is like that shown in U.S. Pat. No. 4,085,284. In this patent, however, it is taught to bond the overlaps, referred to previously, either to the jacket 2 or to the adjacent terminal portion of the single metal tape screen. It has been found that this is not necessary and in some instances undesirable. It is preferred that no such bonding take place.

Referring to FIGS. 3*a* and 3*b*, there is shown a specific example of the tape 3 before and after it is corrugated, it being understood that the tape is preferably corrugated prior to it being included in the cable structure and that the dimensions are given for purposes of illustration only. FIG. 3*a* shows a cross section of an uncorrugated tape 3 having a cross section like that shown in FIG. 1*a*. The iron or steel center layer 8 may be 3 mils in thickness, two outer copper or aluminum layers 9, metallurgically bonded to the iron layer 8, of like thickness. The outer plastic coating 10 on the outermost surface of the aluminum layers 9 may be 2 mils for a total exemplary thickness of 13 mils. After corrugation, the previously flat tape of FIG. 3*a* has a cross section as shown in FIG. 3*b*. The effective thickness of tape of FIG. 3*a*, 13 mils in its uncorrugated state, has been increased to 40 mils in its corrugated state FIG. 3*b*, thus giving rise to an excess of 300% in effective thickness. This is believed to play a role in the shielding between group 4*a* and 4*b* because of the effective increased physical separation obtainable when employing a corrugated tape compared to an uncorrugated tape. The more physically separated the conductors of group 4*a* are from 4*b*, the more effective the electrical shielding.

Corrugation is thought to yield more effective electrical shielding vis-à-vis uncorrugated (flat) tape for still another reason. When the electrical signals of one group confronts the corrugated shielding, there is more metal for it to confront compared to a flat shield per unit area; thus more effective shielding.

Another contribution that corrugations contribute to the mechanical properties of the cables is increased resistance to cracking and breaking of the screen, arising out of bending along any of the axes of the cable.

Furthermore, since the screen has an iron or steel core (layer 8), it imparts to the cable armor protection that prior art cables had only after and if they employed a separate armor tape, in addition to a screen tape. This invention combines the two functions, screening and armoring, into one element.

Laminate 3, made of different metals, insures a certain magnetic wave reflection loss in addition to its inherent attenuation loss, because the amount of reflection at each metal to metal interface depends on a difference in the value of the quotient of the permeability divided by the conductance of the materials, as disclosed in Nyquist. It is preferable that the metal layers 8 and 9 be metallurgically bonded one to the other; if such is not the case, water or water vapor entering the cable will corrode the iron to a point whereby the cable becomes essentially useless. Plastic layers 10 covering the outer surfaces of aluminum layers 9 increase resistance to attack from water and water vapor and thus contribute to the water resistance of the cable.

Although the invention has been described in considerable detail, such detailed description is only for the purpose of illustrating specific embodiments. It is evident that variations and modifications can be made from those described without departing from the spirit and scope of the invention.

What is claimed is:

1. A cable comprising:

(a) a tubular covering of thermally conductive plastic having an inner peripheral surface that delimits a core-receiving cavity;

(b) a core made of two longitudinally extending groups of conductors insulated from one another, received in said core-receiving cavity and nested within said tubular covering, one of said groups adapted to transmit signals in one direction and the other group adapted to transmit signals in an opposite direction;

(c) a single metal shielding tape composed of a medial portion and two terminal portions, said medial portion being integrally joined to and in between the two terminal portions, radially extending between said groups of conductors to shield them one from the other, and each terminal portion extending circumferentially in opposite directions to each other around one of the groups until it reaches to and extends beyond the location where the other terminal portion merges with the medial portion; and, (d) all portions of said metal shielding tape being insulated from said conductors, corrugated and composed of first, second and third metal layers bonded one to the other, said first and third layers being of one metal and of substantially co-equal thickness bonded to the opposite surfaces of said second layer of a second metal, each of said metal layers having a thickness of about 3 mils.

2. A cable as described in claim 1 wherein the outermost surfaces of the first and third layers of the metal shielding tape are coated with a corrosion protecting plastic layer.

3. A cable as described in claim 2 wherein the corrosion protecting plastic layer on the outermost surface of said single metal shielding tape is partly coated with a filling compound that is adapted to prevent bonding of a portion of the single metal shielding tape to itself.

4. A cable as described in claim 1 wherein the space delimited by the single metal tape shield which is otherwise occupied by the conductors is at least partially occupied by a filling compound.

5. A cable as described in claim 1 wherein the bond between said first, second and third metal layers is a metallurgical bond.

6. A cable as described in claim 1 wherein said first and third metal layers are made from copper, aluminum or alloys thereof and said second layer is made from iron, steel or alloys thereof.

* * * * *